United States Patent [19]

Madara

[11] Patent Number: 4,915,652

[45] Date of Patent: Apr. 10, 1990

[54] SHIELDED ELECTRICAL CONNECTOR

[75] Inventor: Scott D. Madara, Raritan, N.J.

[73] Assignee: Thomas & Betts Corporation, Bridgewater, N.J.

[21] Appl. No.: 364,283

[22] Filed: Jun. 12, 1989

[51] Int. Cl.[4] ..... H01R 13/648

[52] U.S. Cl. ..... 439/607

[58] Field of Search ..... 439/108, 607–610

[56] References Cited

U.S. PATENT DOCUMENTS

| | | | |
|---|---|---|---|
| Re. 32,502 | 9/1987 | Kumar | 439/92 |
| 3,329,925 | 7/1967 | Johnson et al. | 339/91 |
| 4,195,198 | 3/1980 | Krause | 174/94 |
| 4,272,148 | 6/1981 | Knack, Jr. | 339/143 |
| 4,337,989 | 7/1982 | Asick et al. | 339/143 |
| 4,386,814 | 6/1983 | Asick | 339/14 |
| 4,506,937 | 3/1985 | Cosmos et al. | 339/14 |
| 4,518,209 | 5/1985 | Negley | 339/14 |
| 4,521,062 | 6/1985 | Kurbikoff et al. | 339/14 |
| 4,557,545 | 12/1985 | Ohtsuki et al. | 339/103 |
| 4,655,518 | 4/1987 | Johnson et al. | 339/17 |
| 4,679,883 | 7/1987 | Assini et al. | 439/607 |
| 4,687,263 | 8/1987 | Cosmos et al. | 439/108 |
| 4,689,723 | 8/1987 | Myers et al. | 361/424 |
| 4,690,479 | 9/1987 | Hollyday et al. | 439/97 |
| 4,799,901 | 1/1989 | Pirc | 439/620 |

OTHER PUBLICATIONS

Photographs.

*Primary Examiner*—Gary F. Paumen

*Attorney, Agent, or Firm*—Robert M. Rodrick; Salvatore J. Abbruzzese

[57] ABSTRACT

An electrical connector attachable to a printed circuit board is disclosed. The connector includes an insulative housing and mounting ears which permit attachment of the connector to the printed circuit board. The connector further includes shielding means for shielding the connector from electromagnetic and radio frequency interferences. The shielding means includes first and second planar metallic shields having shield extending portion which overlie the mounting ears of the housing. Fastening devices used to secure the connector to the printed circuit board may also be employed to secure the shields to the connector housing.

10 Claims, 3 Drawing Sheets

F I G. I

SHIELDED ELECTRICAL CONNECTOR

FIELD OF THE INVENTION

This invention relates generally to an electrical connector attachable to a printed circuit board and more particularly relates to an electrical connector having a metallic shield therearound which shields the connector from electromagnetic and radio frequency interferences.

BACKGROUND OF THE INVENTION

The benefits of providing a metallic shield around an electrical connector have long been known. Electromagnetic interference (EMI) and radio frequency interference (RFI) can be reduced, if not eliminated, if a suitable shield is placed around an electrical connector and connected to ground potential to drain the interferences to ground.

Many connectors employ metallic shells or shields therearound to effectively provide such function. However, many of these shields are bulky and must employ separate hardware to secure the shields to the connector.

In addition, many connector applications require that the connector be repeatedly inserted and removed from a mating connector housing where the mating connector housing has electrical contacts therein which make ground connection to the electrical shield to establish ground continuity between the mating connectors. Often during repeated cycles of insertion and removal, prior art connection devices have encountered the problem of the connector shield dislodging from the connector housing. This is especially true where attempts have been made to reduce the hardware necessary to secure the shield to the housing.

Another problem encountered in shielded connector applications is that certain of these connectors are supported on a printed circuit board. The contacts extending from the connector must be soldered to through-holes in the printed circuit board. The typical soldering process may include moving the connector and the printed circuit board through a solder wave where it is subject to vibration. Again, it is important that the shield be securely mounted to the connector housing to avoid the possibility of the shield dislodging from the connector housing during the wave solder process.

It is desirable to provide a shielded electrical connector where the shield of the connector is supported to the housing without the use of additional mounting hardware and further where the shield will be securely retained on the housing regardless of soldering vibration or insertion and removal stress.

SUMMARY OF THE INVENTION

It is an object of the present invention to provide an electrical connector having a metallic shield therearound which is securely retained on the housing of the connector.

It is a further object of the present invention to provide a shielded electrical connector where the shield of the connector is supported to the connector housing without the use of additional securement hardware.

In the efficient attainment of these and other objects, the present invention provides an electrical connector for attachment to a printed circuit board. The connector includes an insulative housing having a connection surface and an attachment surface which is attachable to a printed circuit board. Mounting ears extending from the housing provide a securement member for securing the connector to the printed circuit board. Plural electrical contacts are supported in the housing having a connection end adjacent the connection face and contact tails extending through the attachment surface for electrical engagement with through-holes of the printed circuit board. The connector includes shielding means for shielding the connector from electromagnetic and radio frequency interferences. The shielding means includes first and second planar shields along opposed longitudinal surfaces of the connector housing. The first shield includes shield extending portions which overlie the mounting ears of the housing and the second shield also includes shield extending portions having extents which wrap around the mounting ears and overlie the extending portions of the first shield. The arrangement of the shield extending portions of the first and second shields permit use of mounting hardware, normally associated with the mounting of the connector housing to the printed circuit board, to also secure the shield to the housing.

As shown by way of the preferred embodiment herein, the connector further includes plural tabs spaced along the longitudinal edge of first and second shield which extend toward the insulated housing. The housing includes plural slots spaced therealong which accommodate the tabs to positionally confine the shield to the housing.

DETAILED DESCRIPTION OF THE PREFERRED EMBODIMENT

Figure 1:
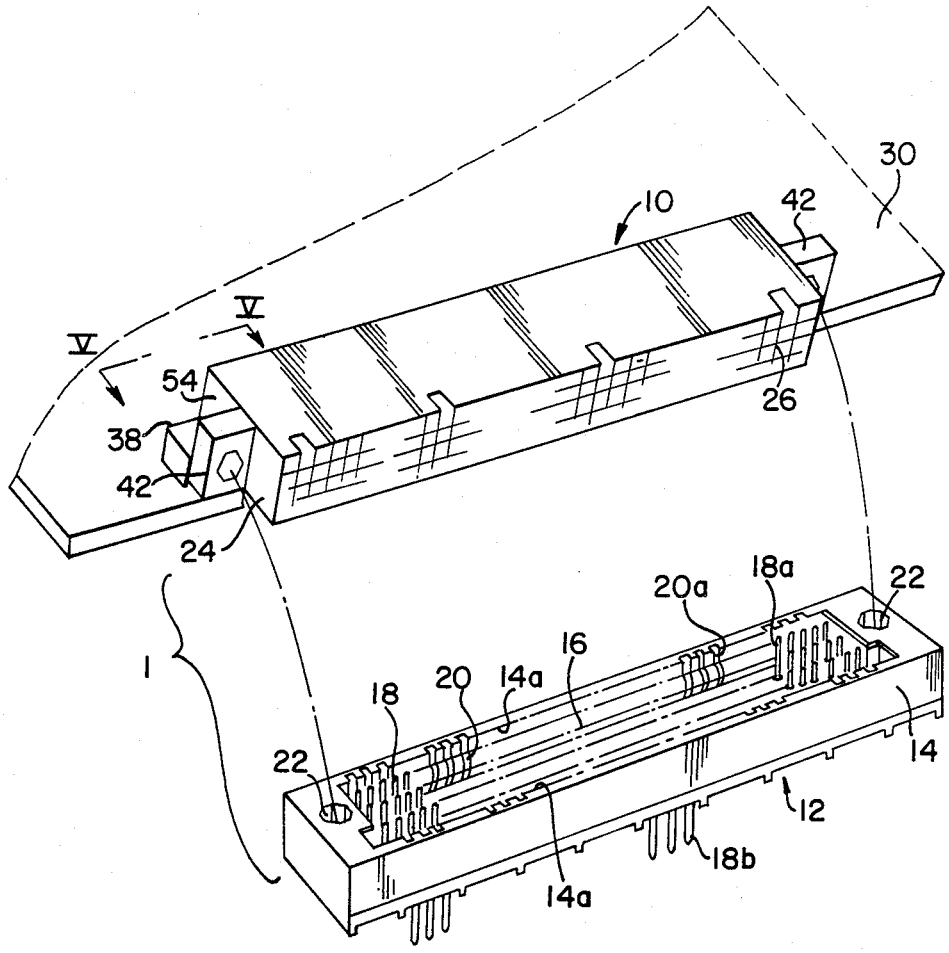
FIG. 1 shows in perspective, the shielded electrical connector of the present invention secured to a printed circuit board shown in phantom and shown removed from its associated mating electrical connector.

Referring to FIG. 1 an electrical connection assembly 1 is shown. Connection assembly 1 includes a male shielded electrical connector 10 and a mating female socket connector 12. Connectors 10 and 12 are designed for mating electrical connection, with male shielded connector 10 being insertable into female socket connector 12.

Female socket connector 12 is a conventional multipin electrical connector including an elongate insulative housing 14 defining a central cavity 16 which accommodates in removable disposition male shielded connector 10. Housing 14 supports a plurality of electrical contact pins 18 having upper portions **18*a* extending into cavity 16 and opposed lower portions 18*b* extending exteriorly through housing 14. Housing 14 also supports a plurality of additional electrical contacts 20 along the interior sidewalls 14*a* thereof. Electrical contacts 20 are spring type contacts having upper spring portions 20*a* which extend into cavity 16. As will be described in greater detail hereinbelow, contact pins 18 are designed for electrical connection with mating contacts of male shielded connector 10 while electrical contacts 20 are designed for connection with the shielded portions of male shielded connector 10. Housing 14 further includes at the ends thereof, mounting apertures 22 which receive appropriate hardware (not shown) to secure male shielded connector 10 to female socket connector 12**.

Figure 2:
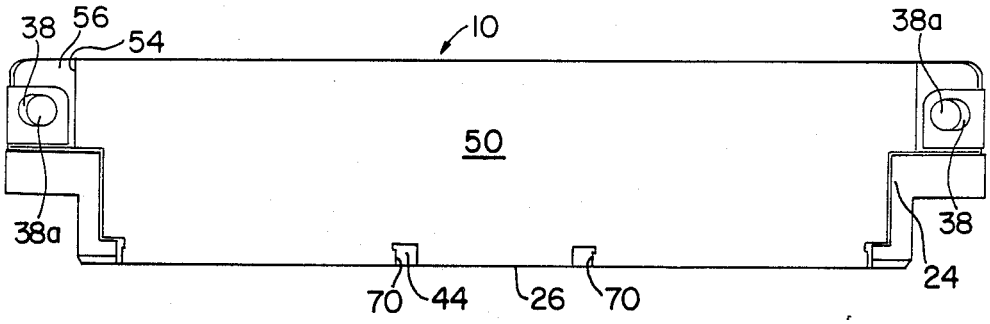
FIGS. 2 through 4 show top, front and bottom plan views respectively of the shielded electrical connector of the present invention.
Figure 3:
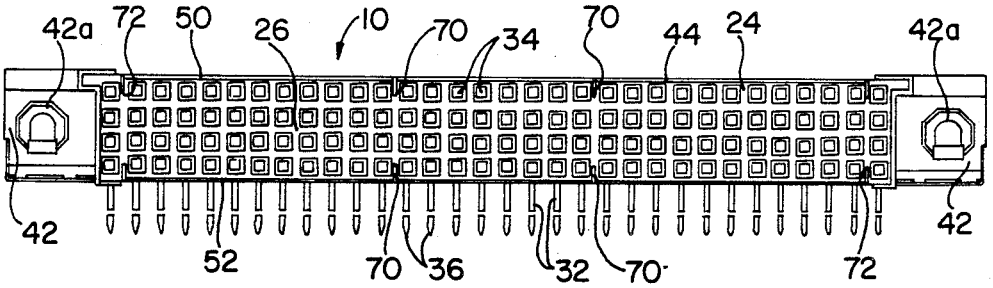
Figure 4:
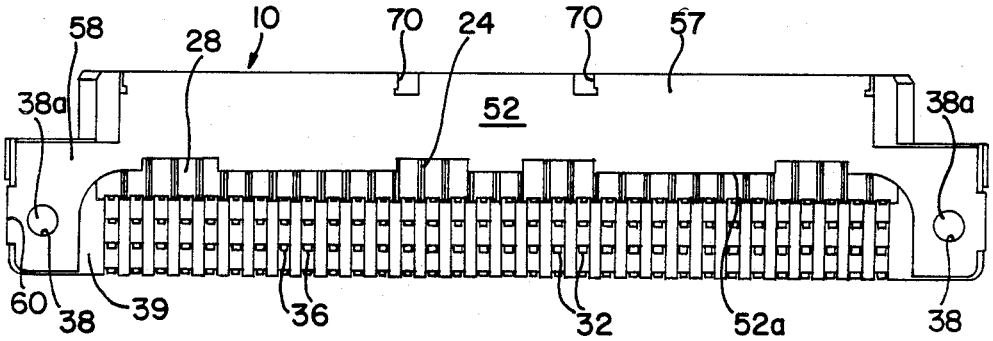

With additional reference to FIGS. 2 through 4 male shielded connector 10 of the present invention may further be described. Shielded connector 10 includes an elongate insulative housing 24 having a generally rectangular shape and structured to be accommodated in the cavity 16 of female socket connector 12. Housing 24 includes a connection surface 26 along one longitudinal side thereof and an attachment surface 28 (FIG. 4) along another longitudinal side thereof.

In the particular embodiment shown in the present invention, connection surface 26 is disposed in a plane which is perpendicular to the plane containing attachment surface 28, to form what is known in the industry as a right-angle connector. As attachment surface 28 is secured to a printed circuit board 30, shown in phantom in FIG. 1. In the present invention, connection of male shielded connector 10 to female socket connector 12 is made in a direction parallel to the plane of the printed circuit board 30. It is, however, contemplated that the present invention may be practiced in a straight-through connector, that is, a connector having a connection surface and an attachment surface in spaced parallel orientation.

Male shielded connector 10 further includes a plurality of electrical terminals 32 (FIGS. 3 and 4) in like number to the number of contact pins 18 in female socket connector 12 for electrical connection therewith. Terminals 32 are of the right-angle variety having a connection portion 34 disposed at a right-angle to a terminal tail 36. As shown in FIG. 3 in preferred embodiment, connection portion 34 of terminal 32 is formed into a conventional socket for electrical engagement with the contact pins 18 upon insertion of male shielded connector 10 into female socket connector 12. However, other conventionally formed terminal shapes may be employed. Connection portions 34 of terminals 32 are positioned along connection surface 26, to facilitate interconnection with contact pins 18. Terminal tails 36 extend beyond attachment surface 28 to make electrical interconnection with plated through-holes (not shown) of printed circuit board 30.

In order to positionally secure male shielded connector 10 to printed circuit board 30, male shielded connector 10 includes board mounting ears 38 extending from each transverse end thereof As shown in more detail in FIGS. 2 and 4, board mounting ears 38 extend outwardly from housing 24 and include a central aperture **38*a* alignable with like apertures (not shown) on printed circuit board 30. A conventional nut and bolt assembly 40, shown more specifically in FIG. 5, may be used to secure male shielded connector 10 to printed circuit board 30**.

Male shielded connector 10 further includes connector mounting ears 42 adjacent each of board mounting ears 38. Shown more specifically in FIG. 3, connector mounting ears 42 include a central aperture **42*a* alignable with mounting apertures 22 of female socket connector 12 so that a fastening device (not shown) may be inserted therethrough to secure male shielded connector 10 to female socket connector 12**.

In order to shield male shielded connector 10 from electromagnetic interferences (EMI) and radio frequency interferences (RFI), connector 10 includes shields 50 and 52 along housing 24. Each of shields 50 and 52 is an elongate substantially planar member formed of an electrically conductive material, preferably metal.

Figure 5:
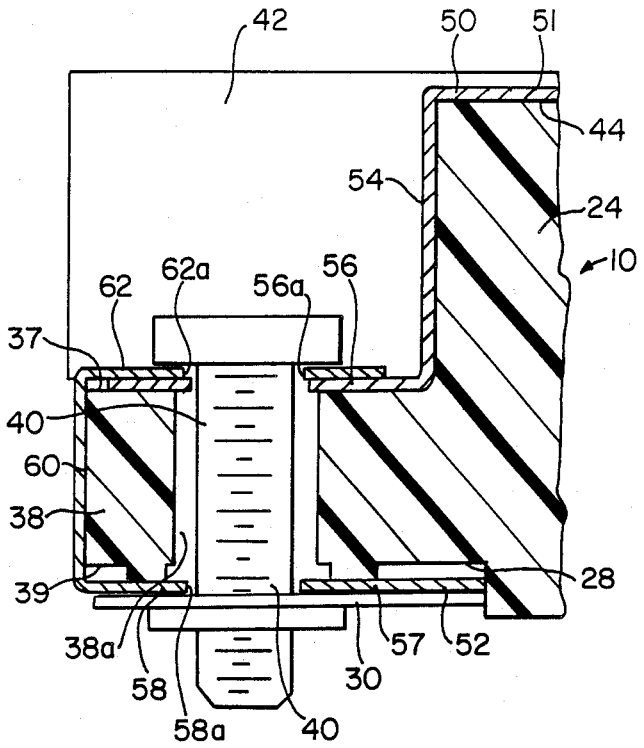
FIG. 5 is a partially fragmented sectional showing of a mounting ears of the connector of the present invention.

Referring to FIGS. 2 and 5, shield 50 is disposed on an upper longitudinal surface 44 of housing 24. Shield 50 includes a planar portion 51 partially coextensive with upper surface 44. A depending portion 54 extends downward toward each board mounting ear 38. Shield 50 further includes a projecting portion 56 which extends over an upper surface 37 of board mounting ear 38. An opening **56*a* is alignable with aperture 38*a* of mounting ear 38**.

Referring FIGS. 4 and 5, lower shield 52 is positioned along attachment surface 28 of housing 24. Shield 52 includes a planar portion 57 which is partially coextensive with attachment surface 28, however, having a cutaway portion **52*a* permitting passage of terminal tails 36 therethrough. A pair of opposed lateral extents 58 extend over a lower surface 39 of board mounting ears 38. Each lateral extent 58 includes an opening 58*a* therethrough alignable with the aperture 38*a* of board mounting ears 38. Lateral extents 58 further include upstanding side portions 60 which extend upward toward upper shield 50. A distal end extent 62 extends at a right angle to side portion 60 over the projecting portion 56 of upper shield 50. An opening 62*a* in distal end extent 62 is alignable with opening 56*a* of projection portion 56 of shield 50 and also alignable with aperture 38*a* of mounting ear 38. The lateral extent 58, upstanding side portion 60 and distal end extent 62 actually wrap-around shield ear 38 and projecting portion 56 of shield 50, to partially enclose projecting portion 56 and shield ear 38**.

As is clearly depicted in FIG. 5, providing a shield formed in such fashion permits nut and bolt assembly 40 not only to secure housing 14 to printed circuit board 30 but also to secure each of shield 50 and 52 to housing 14. Thus, mounting hardware normally associated with the securement of male shielded connector 10 to printed circuit board 30 may also be used to secure the metallic shields 50 and 52 to the connector housing 14. Any vibratory forces which may be encountered will not cause the shields 50 and 52 to be dislodged from housing 24, as the nut and bolt assembly 40 securing male connector 10 to printed circuit board 30 also secures the shields 50 and 52.

Referring again to FIGS. 1 through 4, shields 50 and 52 are additionally secured to housing 24 along the longitudinal edges thereof adjacent connection surface 26. Each of shields 50 and 52 includes plural inwardly projecting tabs 70 which project into housing 24. As shown in FIGS. 2 through 4 each of shields 50 and 52 includes four such tabs 70 spaced longitudinally thereacross which are punched from the planar portions 51 and 57 of the respective metallic shields 50 and 52 Housing 24 includes plural slots 72 (co-extensive with tabs 70 as shown in FIG. 3) adjacent connection surface 26 which receive each of tabs 70. The arrangement of the tabs 70 and the slots 72 serve to securely position each of shields 50 and 52 with respect to housing 24. Thus, upon repeated insertion and removal of male shielded connection 10 with female socket connector 12 (FIG. 1) the shield will remain securely in place with respect to housing 24.

Various changes to the foregoing described and shown structures would now be evident to those skilled in the art. Accordingly, the particularly disclosed scope of the invention is set forth in the following claims.

I claim:

1. An electrical connector for attachment to a printed circuit board comprising:

an elongate insulative housing having a connection surface an attachment surface, and printed circuit board-mounting ears extending from each longitudinal end;

plural electrical contacts supported in said housing, each said contact having a connection end adjacent said connection surface of said housing and a contact tail extending through said attachment surface for electromechanical engagement with said printed circuit board; and means for shielding said housing from electromagnetic and radio frequency interferences, said shielding means including a first planar conductive shield overlying a first longitudinal surface of said housing, said first shield having first shield extending portions overlying said printed circuit board mounting ears of said housing, and a second shield overlying a second longitudinal surface of said housing, opposed to said first longitudinal housing surface, said second shield having second shield extending portions which wrap at least partially around said printed circuit board mounting ears and overlie said first shield extending portions.

2. An electrical connector of claim 1 wherein said printed circuit board-mounting ears each include a first ear surface adjacent said first longitudinal surface of said housing and a second ear surface opposed to said first ear surface and adjacent said second longitudinal surface of said housing.

3. An electrical connector of claim 2 wherein said printed circuit board-mounting ears each include a mounting aperture therethrough extending between said first and second ear surfaces.

4. An electrical connector of claim 3 wherein each of said shield extending portions of said first shield overlies said first ear surfaces of said mounting ears and wherein each said shield extending portion of said first shield includes an opening therethrough in alignment with said mounting ear aperture.

5. An electrical connector of claim 4 wherein each of said shield extending portions of said second shield includes a lateral extent overlying said second ear surface and a distal extent continuous with said lateral extent and overlying said first ear surface and said shield extending portion of said first shield.

6. An electrical connector of claim 5 wherein said lateral extent of each said second shield extending portion includes a first ear opening-therethrough in alignment with said aperture of the respective mounting ear and said distal portion of each said second shield extending portions includes a second opening therethrough in alignment with said aperture of the respective said mounting ear.

7. An electrical connector of claim 6 further including fastening means for securing said first and second shields to said housing and securing said housing to said printed circuit board.

8. An electrical connector of claim 7 wherein said fastening means includes mounting posts insertable through said second openings in said distal portions of said second shield extending portions, said opening in said extending portion of said first shield, said mounting ear aperture; and said opening in said lateral extent of said second shield extending portions.

9. An electrical connector of claim 1 further including means for securing said first and second shield respectively to said first and second longitudinal surfaces of said housing.

10. An electrical connector of claim 9 wherein said securing means includes plural tabs spaced along a longitudinal edge of said first and second shields and extending transversely inwardly toward said housing and plural slots spaced along each longitudinal edge of said housing, said slots receiving said tabs to positionally confine said shields to said housing.

* * * * *